US005355351A

United States Patent [19]

Yoshikawa et al.

[11] Patent Number: 5,355,351

[45] Date of Patent: Oct. 11, 1994

[54] UNDERWATER LOW-FREQUENCY SOUND PRODUCER USING A RARE EARTH ALLOY

[75] Inventors: Takashi Yoshikawa; Akiyoshi Kawamori; Hiroshi Kamata, all of Tokyo; Iwao Nakano, Yokosuka; Toshio Tsuchiya, Yokosuka; Yasutaka Amitani, Yokosuka, all of Japan

[73] Assignees: Oki Electric Industry Co., Ltd., Tokyo; Japan Marine Science and Technology Center, Yokosuka, both of Japan

[21] Appl. No.: 92,608

[22] Filed: Jul. 16, 1993

[30] Foreign Application Priority Data

Jul. 22, 1992 [JP] Japan ..... 4-195271

[51] Int. Cl.[5] ..... H04R 15/00

[52] U.S. Cl. ..... 367/156; 367/168; 367/171; 310/337

[58] Field of Search ..... 367/156, 168, 153, 158, 367/166, 171; 310/337

[56] References Cited

U.S. PATENT DOCUMENTS

| | | | |
|---|---|---|---|
| 4,438,509 | 3/1984 | Butler et al. | 367/156 |
| 4,642,802 | 2/1987 | Pozzo et al. | 367/168 |
| 4,703,464 | 10/1987 | Howarth et al. | 367/156 |
| 4,907,209 | 3/1990 | Sewell et al. | 367/168 |

FOREIGN PATENT DOCUMENTS 4-96600 3/1992 Japan .

OTHER PUBLICATIONS

Report of the Meeting, the Acoustical Society of Japan, Oct. 1991, p. 1071; "Tonpilz Transducer Using TbDyFe Alloy", Yoshikawa et al.

Conference Proceedings, UDT 1991 Conference + Exhibition, Apr. 23–25, 1991, pp. 1059–1065, "Design of Lanthanide Magnetostrictive Sonar Projectors", Claeyssen, et al.

*Primary Examiner*—J. Woodrow Eldred

*Attorney, Agent, or Firm*—Spencer, Frank & Schneider

[57] ABSTRACT

An underwater low-frequency sound producer comprises vibrator units each including a magnetostrictive rod formed of a rare-earth alloy, a permanent magnet for providing a magnetic bias to the rod, prestress bolts for prestressing the rod, a coil wound on the rod for causing magnetostriction of the rod corresponding to an input AC signal applied to the coil, and first and second masses on opposite ends of the rod. The vibrator units are arranged seriatim end-to-end to define a polygon or ring centered on an axis. Connection blocks respectively connect the first and second masses of the vibrator units adjacent to each other. Vibration plates are respectively attached to the connection members. Outer and inner cylindrical boots and upper and lower plates define an annular space in which the vibrator units are disposed. The annular space is filled with oil having an acoustic impedance similar to that of the water in which the sound producer is placed for use.

27 Claims, 10 Drawing Sheets

UNDERWATER LOW-FREQUENCY SOUND PRODUCER USING A RARE EARTH ALLOY

BACKGROUND OF THE INVENTION

The present invention relates to an underwater low-frequency sound producer using a Langevin-type transducer.

Conventional technology of this type is described in "Tonpilz transducer using TbDyFe Alloy" by Takashi Yoshikawa, et al., in the Report of the Meeting, the Acoustical Society of Japan, October 1991, page 1071, and Japanese Patent Application H2-214687, some of the authors of which are some of the co-inventors of the present application.

A conventional low-frequency transducer (sound source) of this type comprises a rod of a rare earth alloy and masses attached to opposite ends of the rod.

The conventional transmitter disclosed in the above-mentioned publication has a resonant frequency at 840 Hz and an output sound pressure of 148 dB. It is however desired to have a yet lower resonant frequency and yet a larger sound output. To lower the resonant frequency with the above configuration, it is necessary to use a rod of a smaller diameter or to use heavier masses. This however decreases the mechanical strength of the transmitter. Moreover, to further increase the output, the area used for radiating the acoustic wave must be increased. However, this is limited by the configuration of the prior art transducer.

SUMMARY OF THE INVENTION

An object of the invention is to provide an underwater low-frequency sound producer which is capable of producing a sound of a lower frequency.

Another object of the invention is to provide an underwater low-frequency sound producer which is capable of producing a sound with a greater sound pressure.

A further object of the invention is to enable easy rearrangement of the low-frequency sound producer for changing the frequency of the produced sound.

A further object of the invention is to provide a low-frequency sound producer that can withstand a higher water pressure.

A further object of the invention is to restrict the weight of the sound producer to a minimum.

An underwater low-frequency sound producer using a rare earth alloy according to a first aspect of the invention comprises:

(a) at least three vibrator units (10), each including a magnetostrictive rod (101) formed of a rare-earth alloy, means (121, 131; 401) for providing a magnetic bias to said rod, means (151) for prestressing said rod (101), a coil (102) magnetically coupled to said rod for causing magnetostriction of said rod corresponding to an input AC signal applied to said coil, and first and second masses (131, 141) on opposite ends of said rod;

(b) said vibrator units (10) being arranged in such a manner that the first mass of each of said vibrator units is adjacent to the second mass of another of said vibrator units, each vibrator unit so arranged that its rod extends substantially in the direction tangential to a circle centered on said axis (100);

(c) vibration plates (24), each provided for the first mass of each of said vibrator units and the second mass of another of said vibrator units;

(d) connection members (20), each connected to the first mass of each of the vibrator units and the second mass of another of said vibrator units;

(e) upper and lower plates (26, 25) and outer and inner boots (28, 27) defining a space (3) which is centered on said axis (100) and in which said vibrator units (10) are disposed;

(f) a liquid (30) filling said space, said liquid having an acoustic impedance similar to that of the water in which the sound producer is placed for use.

An underwater low-frequency sound producer using a rare earth alloy according to a second aspect of the invention comprises:

(a) at least three magnetostrictive rods (101) each having first and second ends and arranged in such a manner that the first end of each of said rods is adjacent to the second end of another of said rods;

(b) means (121, 131, 401) for providing a magnetic bias to each of said rods;

(c) means (151) for prestressing each of said rods;

(d) means (102) for applying an AC magnetic field to each of said rods;

(e) vibration plates (24), each provided for a first end of one said rods and a second end of another of said rods adjacent to said one of said rods;

(f) means (20) for connecting each of said vibration plates to said first end of said one of said rods and said second end of said another of said rods;

(g) upper and lower plates (26, 25) and outer and inner boots (28, 27) for defining a space (3) which is centered on said axis (100) and in which said rods and said vibration plates are positioned; and (h) a liquid (30) filling said space, said liquid having an acoustic impedance similar to that of the water in which the sound producer is placed for use.

DETAILED DESCRIPTION OF THE PREFERRED EMBODIMENTS

An embodiment of the invention will now be described with reference to the drawings.

Figure 1:
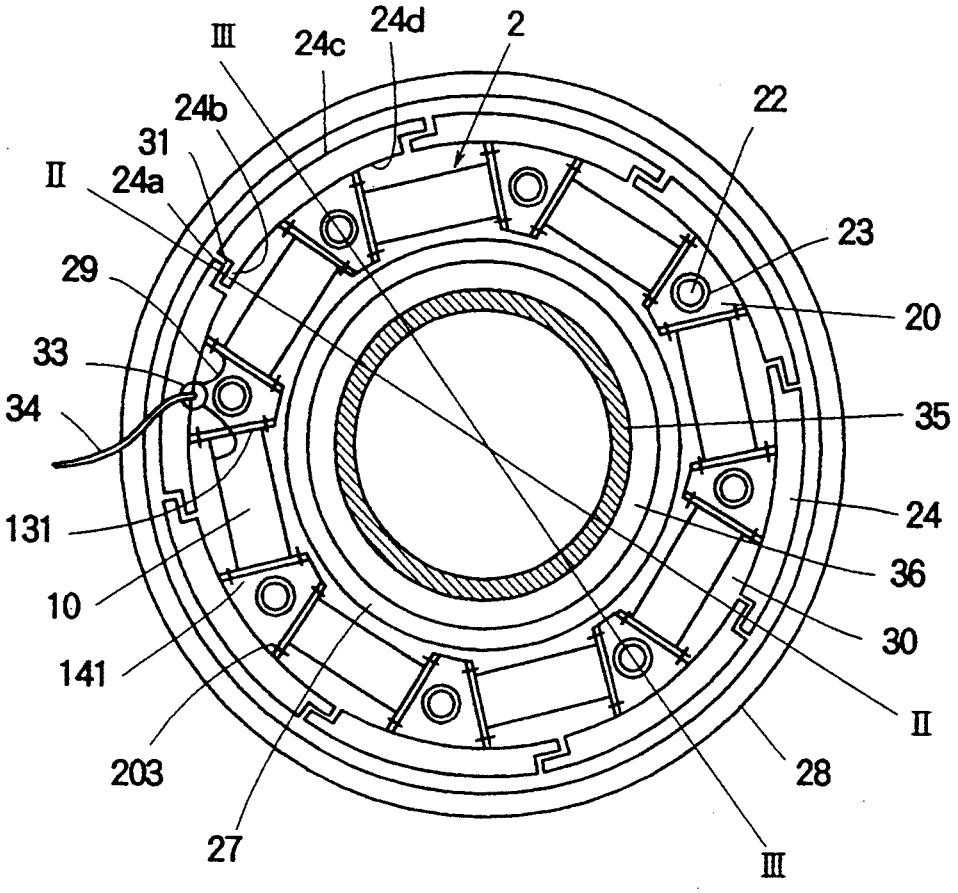
FIG. 1 is a plan sectional view along line I—I in FIG. 2 showing an underwater low-frequency sound producer using a rare earth alloy of an embodiment of the invention.
Figure 2:
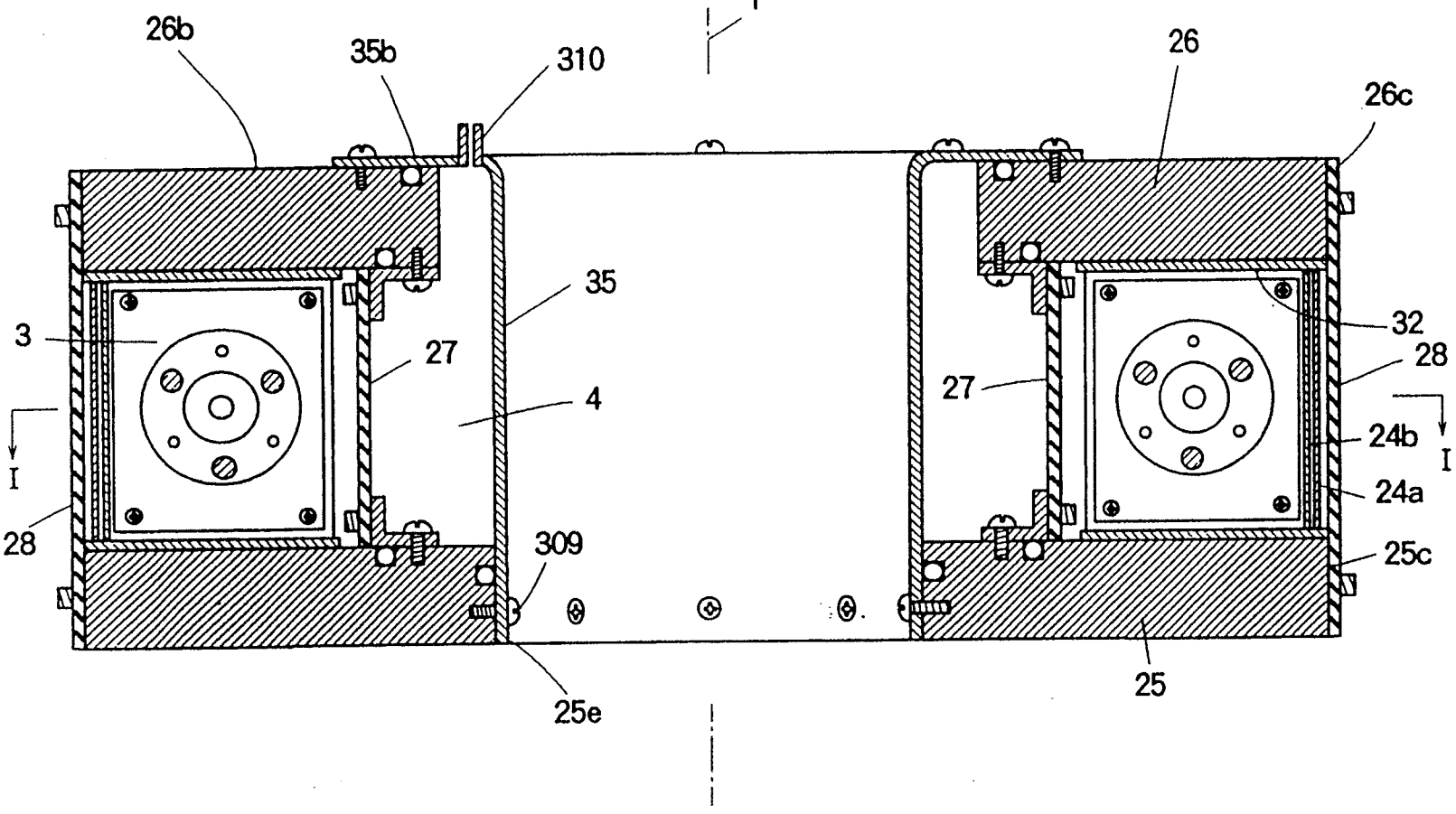
FIG. 2 is a sectional view along line II—II in FIG. 1.
Figure 3:
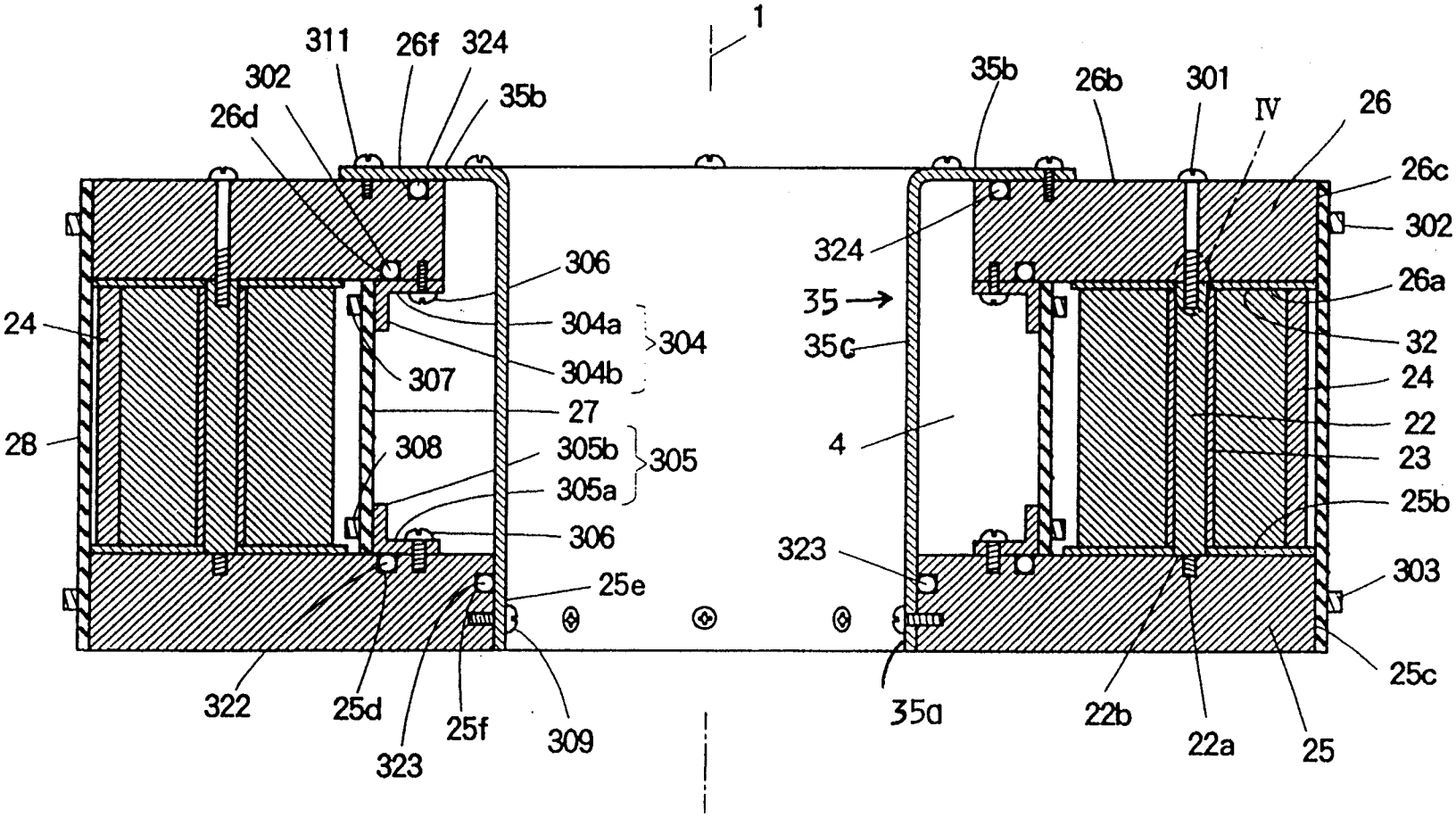
FIG. 3 is a sectional view along line III—III in FIG. 1.

As illustrated in FIG. 1 to FIG. 3, an underwater low-frequency sound producer using a rare earth alloy comprises a plurality of vibrator units 10 arranged to form a polygon or ring 2 centered on an axis 1. The vibrator units 10 each have first and second ends and are disposed in such a manner that the first end of each of the vibrator units 10 is adjacent to the second end of another of the vibrator units 10, and each of the vibrator units 10 extends in the direction tangential to a circle center on the axis 1.

Figure 6:
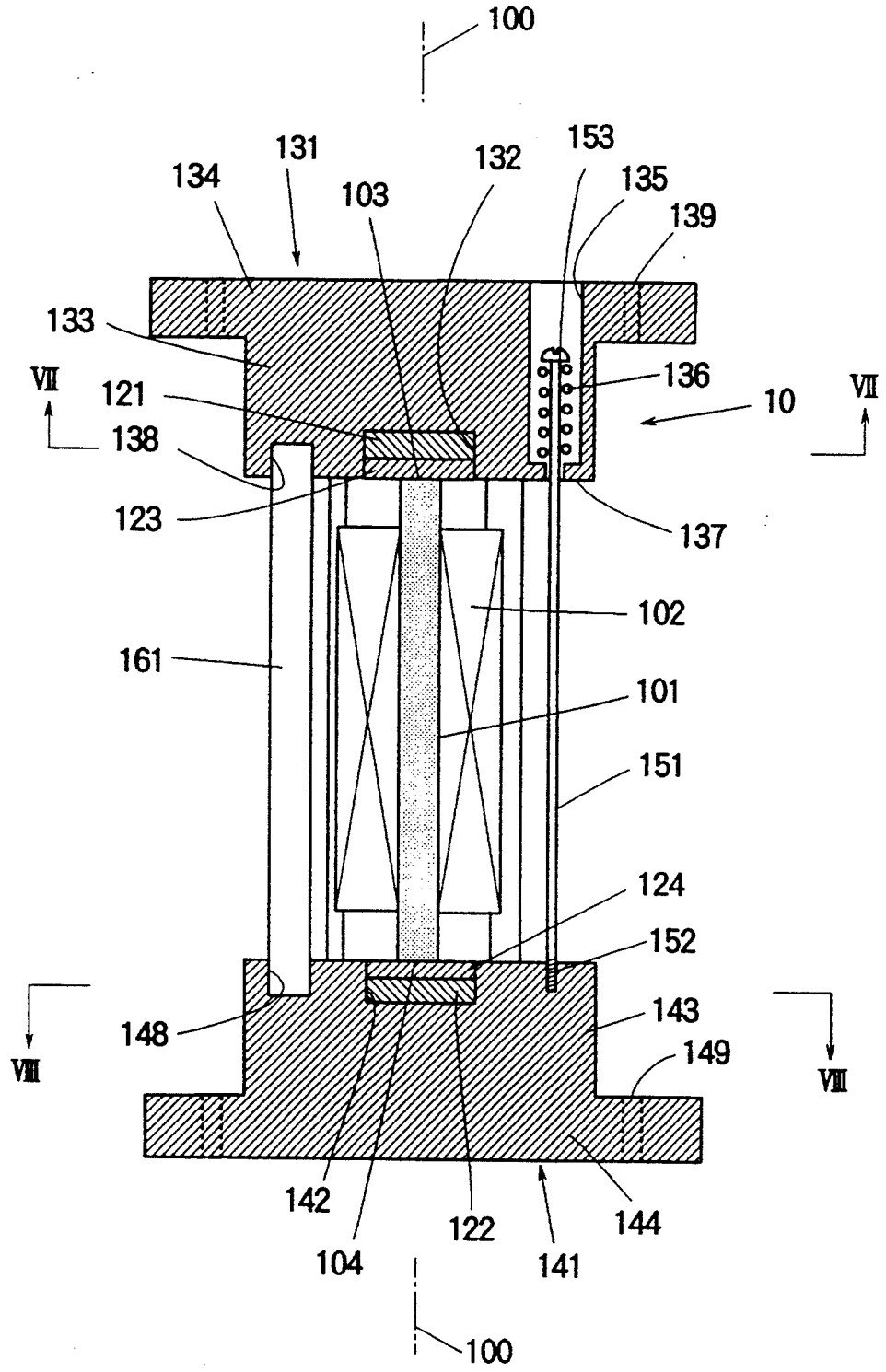
FIG. 6 is a sectional view along line VI—VI in FIG. 7 showing one of the vibrator units used to form the underwater low-frequency sound producer of FIG. 1.

As shown in FIG. 6, each vibrator unit 10 comprises a magnetostrictive rod 101 of a rare earth alloy having giant magnetostrictive characteristics and extending along an axis 100, a solenoid coil 102 wound around the rod 101, disk-shaped permanent magnets 121 and 122 mounted to opposite ends (first and second ends) 103 and 104 of the rod 101 via disk-shaped magnetic couplers 123 and 124 formed of soft iron. The magnetic couplers 123 and 124 are bonded to the opposite ends of the rod 101, and the permanent magnets 121 and 122 are bonded to the magnetic couplers 123 and 124, respectively. The magnetic couplers 123 and 124 have the same diameter as the permanent magnets 121 and 122, and are aligned with the permanent magnets 121 and 122 and interposed between the permanent magnets 121 and 122 and the ends 103 and 104 of the rod 101.

The combination of the magnetic coupler 123 and the permanent magnet 121 on the first or upper end 103 of the rod 101 is fitted in an indent 132 formed in a disk-shaped part 133 of a first mass 131. Similarly, the combination of the magnetic coupler 124 and the permanent magnet 122 on the second or lower end 104 of the rod 101 is fitted in an indent 142 formed in a disk-shaped part 143 of a second mass 141.

The function of the magnetic coupler is to converge the magnetic flux from the permanent magnet and lead the magnetic flux to the relatively thin magnetostrictive rod 101. The magnetic coupler also effectively enlarges the distance between the N and S poles generated by the permanent magnet.

The masses 131 and 141 are each provided with a rectangular flange part 134 or 144, formed integrally with the disk-shaped part 133 or 143. In other words, the disk-shaped part 133 and the rectangular part 134 are a one-piece unit. Similarly, the disk-shaped part 143 and the rectangular part 144 are a one-piece unit. The masses 131 and 141 are formed of a non-magnetic and rigid material such as aluminum.

The first mass 131 is provided with three apertures 135, each for accommodating a coil spring 136. The apertures 135 are arranged around the axis 100 of the disk-shaped part 133, at equal angular intervals and at an equal distance from the axis 100. The aperture 135 has a stopper 137 formed of a reduced diameter part at the bottom of the aperture so as to receive the lower end of the coil spring 136. A prestress bolt 151 is provided for each of the apertures 135, and extends through the coil spring 136 in each aperture 135 and to the disk-shaped part 143 of the second mass 141, and has a threaded lower end 152 threaded into a tapped hole in the disk-shaped part 143 of the second mass 141. Thus, there are three prestress bolts 151 arranged around the rod 101, at equal angular intervals and at an equal distance from the axis 100. The prestress bolt 151 has a head 153 at its upper end, which engages, at its lower surface, with the upper end of the coil spring 136. The head 153 has, on its upper surface, a groove for engagement with a screw driver, not shown. As the bolts 151 are tightened, the rod 101 is compressed, or prestressed, by the bolts 151 via the coil springs 136.

Three anti-twisting rods 161 are arranged around the rod 101, at equal angular intervals and at an equal distance from the rod 101. The rods 161 and the prestress bolts 151 are disposed at angular positions 60° apart from each other. The disk-shaped part 133 of the first mass 131 is provided with indents 138 for receiving upper ends of anti-twisting rods 161. Similarly, the disk-shaped part 143 of the first mass 141 is provided with indents 148 for receiving lower ends of anti-twisting rods 161. The function of the anti-twisting rods 151 is to prevent rotation of the masses 131 and 141 relative to each other, and hence twisting of the magnetostrictive rod 101.

The prestress bolts 151 and anti-twisting rods 161 are not illustrated in FIG. 1 to prevent the drawing from being too complicated.

Each vibrator unit 10 is formed such that it can be used by itself as a vibration element having a single resonant frequency.

Figure 5:
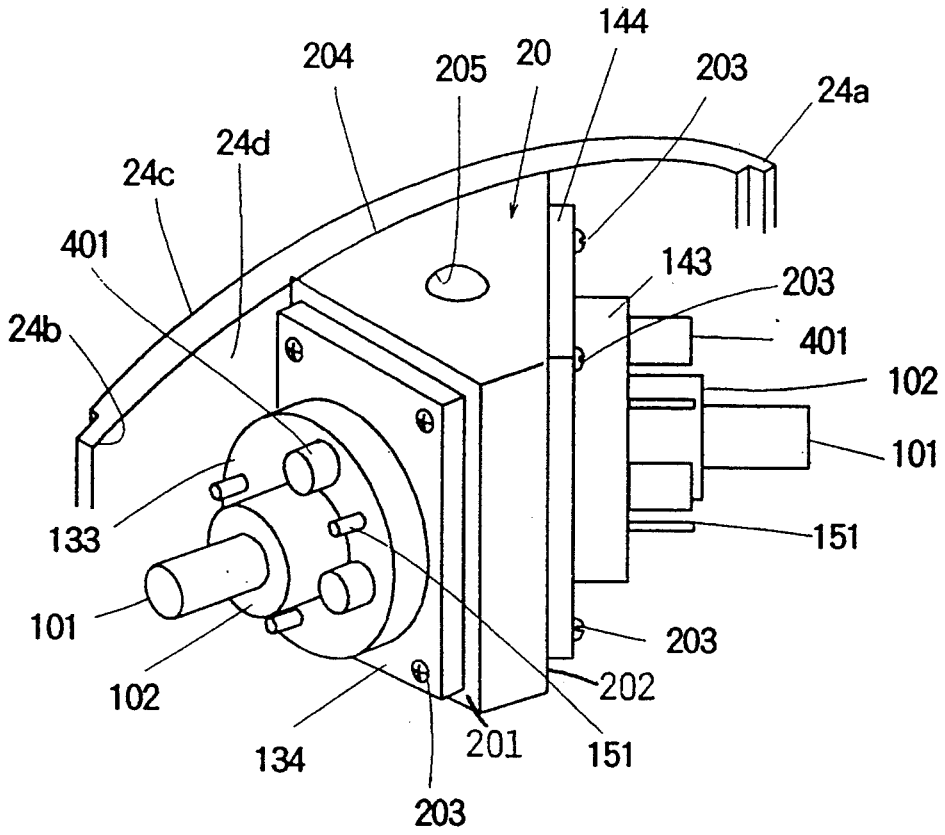
FIG. 5 is a perspective view showing a connection member.

Eight vibrator units 10, each configured as described above, are arranged to form a ring 2, as stated above, and are coupled with each other by means of connection blocks or members 20 as shown in FIG. 5.

More specifically, the connection member 20 is substantially prism-shaped, and has a first and second flat surfaces 201 and 202 which are at 45° with respect to each other. The first and second flat surfaces 201 and 202 are in contact with the masses of the adjacent vibrator units adjacent to each other. In the illustrated example, the rectangular flange part 134 of the first mass 131 of a first one of the vibrator units 10 is in contact with the first flat surface 201, and the rectangular flange part 144 of the second mass 141 of a second one of the vibrator units 10 (adjacent to the above-mentioned first one of the vibrator units) is in contact with the second flat surface 202. The rectangular flange part 134 is provided with holes 139 through which screws 203 are made to extend, and the screws 203 are threaded in tapped holes in the connection member 20. Similarly, the rectangular flange part 144 is provided with holes 149 through which screws 203 are made to extend, and the screws 203 are threaded into tapped holes in the connection member 20.

The connection member 20 may be formed of a non-magnetic and rigid material such as aluminum.

The connection member 20 has an outer partial cylindrical surface 204 (forming part of a cylindrical surface) to which a vibration plate 24 is attached. The vibration plate 24 may be attached to the connection member 20, for example, with screws, not shown, such that the vibration plate 24 is removable for replacement. The vibration plates 24 attached to adjacent connection members 20 have their adjacent edge parts **24*a* and 24*b* overlapping each other, with a minute gap 31 (FIG. 1) between them. For such overlapping, the edge parts 24*a* and 24*b* of the vibration plates 24 are cut stepwise to form thinner parts. For example, one of the adjacent edge parts, 24*a*, is cut stepwise on its inner side to form the thinner part having an outer surface continuous with the major part of the outer surface 24*c* of the vibration plate 24**, while the other of the adjacent edge parts, 24*b*, is cut stepwise on its outer side to form, for example, the thinner part having an inner surface continuous with the major part of the inner surface 24*d* of the vibration plate 24. The assembly of the vibration plates 24, with the adjacent vibration plates overlapping each other, forms a cylindrical wall inside of which the ring of vibrator units 10 is disposed.

The vibration plates 24 may be formed of a non-magnetic and rigid material such as aluminum.

The connection member 20 has a throughhole 205 through which a supporting rod 22 wrapped with a buffer material 23 extends.

Figure 4:
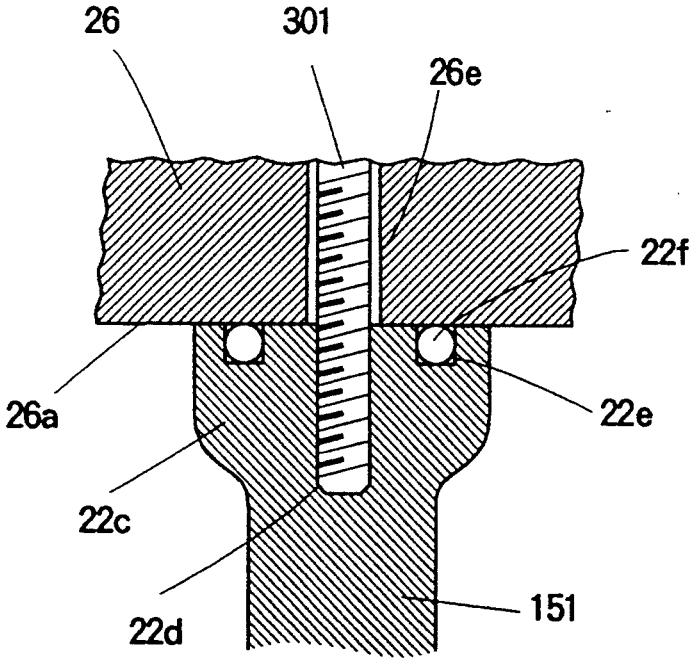
FIG. 4 is an enlarged and detailed sectional view of part IV in FIG. 3.

The ring 2, formed of the eight vibration units 10, is disposed in an annular space 3 defined by an outer cylindrical boot 28, an inner cylindrical boot 27, an upper annular plate 26 and a lower annular plate 25. The upper and lower annular plates 26 and 25 are centered on the axis 1 and have their outer peripheral edges 26*c* and 25*c* aligned with each other. The upper and lower plates 26 and 25 are fixed to each other by means of the supporting rods 22. Eight supporting rods 22 are disposed around the axis 1 of the sound producer, at equal angular intervals and at an equal distance from the axis 1. Each supporting rod 22 is provided, at its lower end, a threaded tip part 22*a* which is threaded into a tapped hole in the lower plate 25. A shoulder 22*b* abuts on the upper surface 25*b* of the lower plate 25. As is better seen in FIG. 4, each supporting rod 22 is provided, at its upper end, an expanded part 22*c* abutting on a lower surface 26*a* of the upper plate 26. Expanded part 22*c* has a tapped hole 22*d* and a circular groove 22*e* for receiving an O-ring 22*f*. A screw 301 is passed through a hole 26*e* in the upper plate 26 and is threaded into the tapped hole 22*d*.

The outer boot 28 is fitted on the outer peripheral edges 26*c* and 25*c* of the upper and lower plates 26 and 25. As illustrated in FIG. 3, belts 302 and 303 are wound on the outer boot 28 over the outer peripheral edges 26*c* and 25*c* to fix the boot 28 to the upper and lower plates 26 and 25 as well as to provide a water-tight seal.

The inner boot 27 is fixed by means of annular fittings 304 and 305 which are mounted to the lower surface 26*a* of the upper plate 26 and the upper surface 25*b* of the lower plate 25.

Each fitting 304 or 305 has an inwardly-extending flange part 304*a* or 305*a* and cylindrical part 304*b* or 305*b* extending from the outer edge of the flange part 304*a* or 305*a*. The flange part 304*a* or 304*b* extends along the lower surface 26*a* of the upper plate 26 or the upper surface 25*b* of the lower plate 25, and cylindrical part 304*b* or 305*b* extends from the outer periphery of the flange part 304*a* or 305*a*. The flange part 304*a* or 305*a* is provided with holes through which screws 306 extend. The screws 306 are threaded into tapped holes in the upper or lower plate 26 or 25. The flange part 304*a* or 305*a* is in contact with an O-ring 322 received in a circular groove 26*d* or 25*d* formed on the lower surface 26*a* of the upper plate 26 or on the upper surface 25*b* of the lower plate 25 to provide a water-tight seal between the fitting 304 or 305 and the upper or lower plate 26 or 25.

The upper edge part of the inner boot 27 is wrapped around the cylindrical part 304*b* of the fitting 304. The lower edge part of the inner boot 27 is wrapped around the cylindrical part 305*b* of the fitting 305.

A belt 307 is wound on the inner boot 27 over the cylindrical parts 304*b* of the fittings 304 to tighten the inner boot 27. Another belt 308 is wound on the inner boot 27 over the cylindrical part 305*b* of the fitting 305 to tighten the inner boot 27.

The upper edges of the vibration plates 24 are in proximity to the lower surface 26*a* of the upper plate 26 and the lower edges of the vibration plates 24 are in proximity to the upper surface 25*b* of the lower plate 25.

A sliding plate 32 is attached to the lower surface of the upper plate 26, and another sliding plate 32 is attached to the upper surface of the lower plate 25. The vibration plates 24 have their upper and lower edges in contact with the sliding plate 32 to leave no gap between the sliding plate 32 and the vibration plates 24, to prevent leakage of sound, i.e., to prevent the sound radiated from the inner surfaces 24*d* of the vibration plates 24 from emanating outward.

The sliding plates 32 are formed of a plastic material and interposed to eliminate direct contact between the vibration plates 24 and the upper and lower plates 26 and 25, and to thereby improve the slidability.

The annular space 3 which is defined and sealed by the upper and lower plates 26 and 25 and the outer and inner boots 28 and 27 and in which the vibrator units 10 are disposed is filled with a liquid, such as oil 30 having an acoustic impedance similar to that of water in which the sound producer is used, so that the sound from the vibration plates 24 is transmitted efficiently (with a minimum loss). The oil 30 also serves to maintain a balance with the pressure of the environmental water, and to improve the heat radiating effect.

The inner and outer boots 28 and 27 are formed of a flexible material having an acoustic impedance close to that of the water in which the sound producer is used and that of the oil 30. A suitable example of the material for the boots 28 and 27 is rubber. Another suitable example is polyurethane foam.

There is further provided a cylindrical wall 35 formed of a rigid material, e.g., aluminum, and positioned inside the inner boot 27 to define an air chamber 4 between the inner cylindrical boot 27 and the cylindrical wall 35. The wall 35 has a cylindrical part 35*c* and a flange part 35*b* extending outward from the upper edge of the cylindrical part 35*c*. The lower end 35*a* of the cylindrical part 35*c* of the wall 35 is fixed to the inner periphery 25*e* of the lower plate 25, by means of screws 309. An O-ring 323 is received in an annular groove 25*f* formed on the inner periphery 25*e* of the lower plate 25 and is in contact with the wall 35 to provide a water-tight seal between the wall 35 and the inner periphery 25*e* of the lower plate 25.

The flange part 35*b* of the wall 35 is connected and fixed to the upper surface 26*b* of the upper plate 26. The flange part 35*b* is fixed to the upper surface 26*b* of the upper plate 26 by means of screws 311. Another O-ring 324 is received in an annular groove 26*f* formed on the upper surface 26*b* of the upper plate 26 and is in contact with the flange part 35*b* to provide a water-tight seal between the lower surface of the flange part 35*b* and the upper surface 26*b* of the upper plate 26.

A tube 310 extends through the flange part 35*b*, so that the interior of the tube 310 and the interior of the air chamber 4 are in communication with each other. The tube 310 is connected to an external pressure compensator, which is not shown but which is provided above water. The pressure compensator serves to maintain the pressure inside the air chamber 4 to balance with the pressure surrounding the sound producer, i.e., the pressure of the water in which the sound producer is submerged.

The function of the air chamber 4 is to decrease the stiffness of the acoustic system formed of the sound producer and the environmental water, to thereby lower the resonant frequency of the acoustic system.

A water-tight connector block 33 extends through the upper plate 26, so that its first end is inside the space 3 and its second end is outside the upper plate 26. Leads 29 (FIG. 1) connected to terminals (not shown) of the solenoid coils 102 of the vibrator units 10 are connected to the first end of the connector block 33. A cable 34 is connected to the second end of the connector block 33. Thus the leads 29 and the cable 34 are connected to each other via the terminal block 33. The number of conductors in the cable 34 depends of whether identical current is applied to all the vibrator units 10 or currents of different phases are applied to the vibrator units.

For holding the sound producer, anchor bolts, not shown, may be threaded into the upper plate 26, and wires may be used for suspending the sound producer.

The prestress bolts 151 are used to prestress the rod 101 so that the rod 101 is maintained in a compressed state, even during vibration, to thereby protect the rod 101 from excessive tensile stress. The permanent magnets 121 and 122 provide a magnetic bias.

In use, the sound producer is placed in water, the cable 34 connected to the water-tight connector 33 is connected to an AC power supply, which is not shown and may be placed above water, and an AC current is supplied to the coil 102 of each vibrator unit 10 to generate a magnetic field superimposed on the magnetic bias (a DC magnetic field) generated by the permanent magnets 121 and 122. Because of the AC electric current, the rod extends and contracts alternately, to cause vibration of the masses 131 and 141 on the opposite ends of the rod 101. The vibration of the masses 131 and 141 is transmitted to the vibration plates 24 which are coupled to the masses 131 and 141 via the connection members 20. Because of the vibration of the vibration plates 24, a sound is radiated from the outer and inner surfaces **24*c* and 24*d* of the vibration plates 24. The sound radiated from the outer surfaces 24*c* of the vibration plates 24 is transmitted through the outer boot 28** to the water in which the sound producer is placed.

The sound radiated from the inner surfaces **24*d* of the vibration plates 24 is mostly prevented from emanating through the adjacent vibration plates 24 because the adjacent vibration plates 24 overlap each other, and only a minute gap 31 is left between them. Thus, it is ensured that the sound that is radiated from the outer surfaces 24*c* is transmitted to the water but the sound radiated from the inner surfaces 24*d*** are not transmitted to the water.

All the vibrator units 10 may be supplied with AC currents of the same phase and of the same magnetite. In such a case, the generated sound has no directivity (on the assumption that the current-to-vibration conversion characteristics of the vibrator units 10 are identical). When some of the vibrator units 10 are supplied with AC currents of a certain phase, and others are supplied with AC currents of an opposite phase, the generated sound has a directivity. For instance, it is possible to generate a sound of a certain phase in the X direction, and a sound of an opposite phase in the Y direction (orthogonal to the X direction), so that no sound is produced in a certain direction between the X and Y direction. If the sound in the X direction and the sound in the Y the direction are of the same strength, no sound is produced in a direction 45° from the X and Y directions.

The frequency of the generated sound can be adjusted by replacement of the vibration plates 24.

In an example of the sound producer of the above configuration, the diameter (diameter of the upper and lower plates) is about 900 mm, and the height (height of the inner and outer boots) is 350 mm.

The sound producer of the above configuration can withstand the water pressure as high as 200 kgf/cm$^2$, so that the sound producer can be submerged to a depth of up to 2000 m. The resonant frequency of the above sound producer can be varied by appropriate selection of the vibration plates 24, and can be set at as low as 200 Hz, and the output power can be increased to as high as 190 dB (0 dB/$\mu$Pa-m: the output power of a sound source which produces a sound pressure of 1$\mu$ Pa at a distance of 1 m from the sound source is defined as 0 dB).

Figure 7:
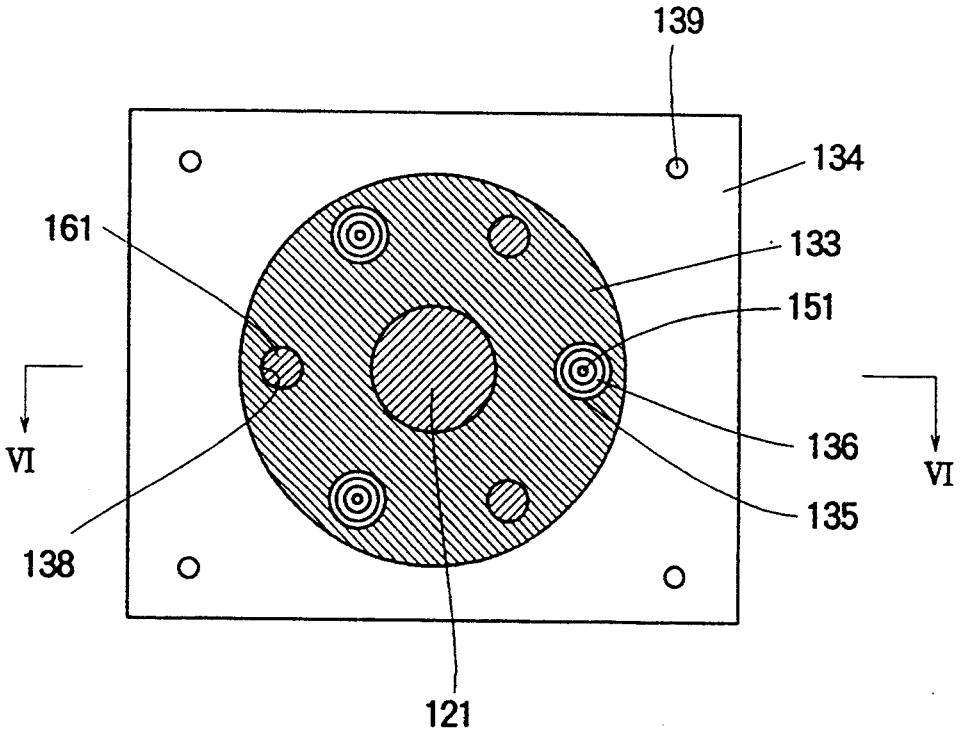
FIG. 7 is a sectional view along line VII—VII in FIG. 6.
Figure 8:
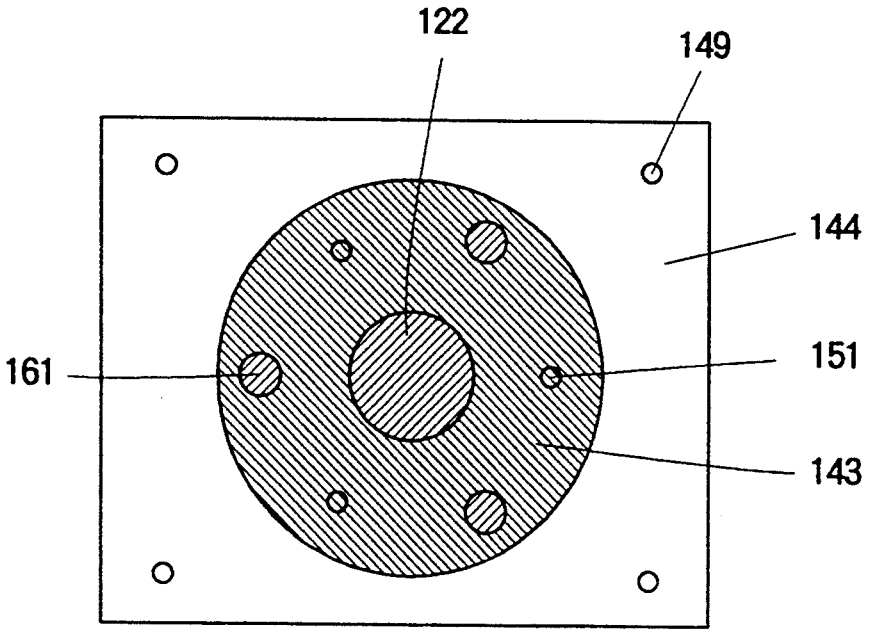
FIG. 8 is a sectional view along line VIII—VIII in FIG. 6.
Figure 9:
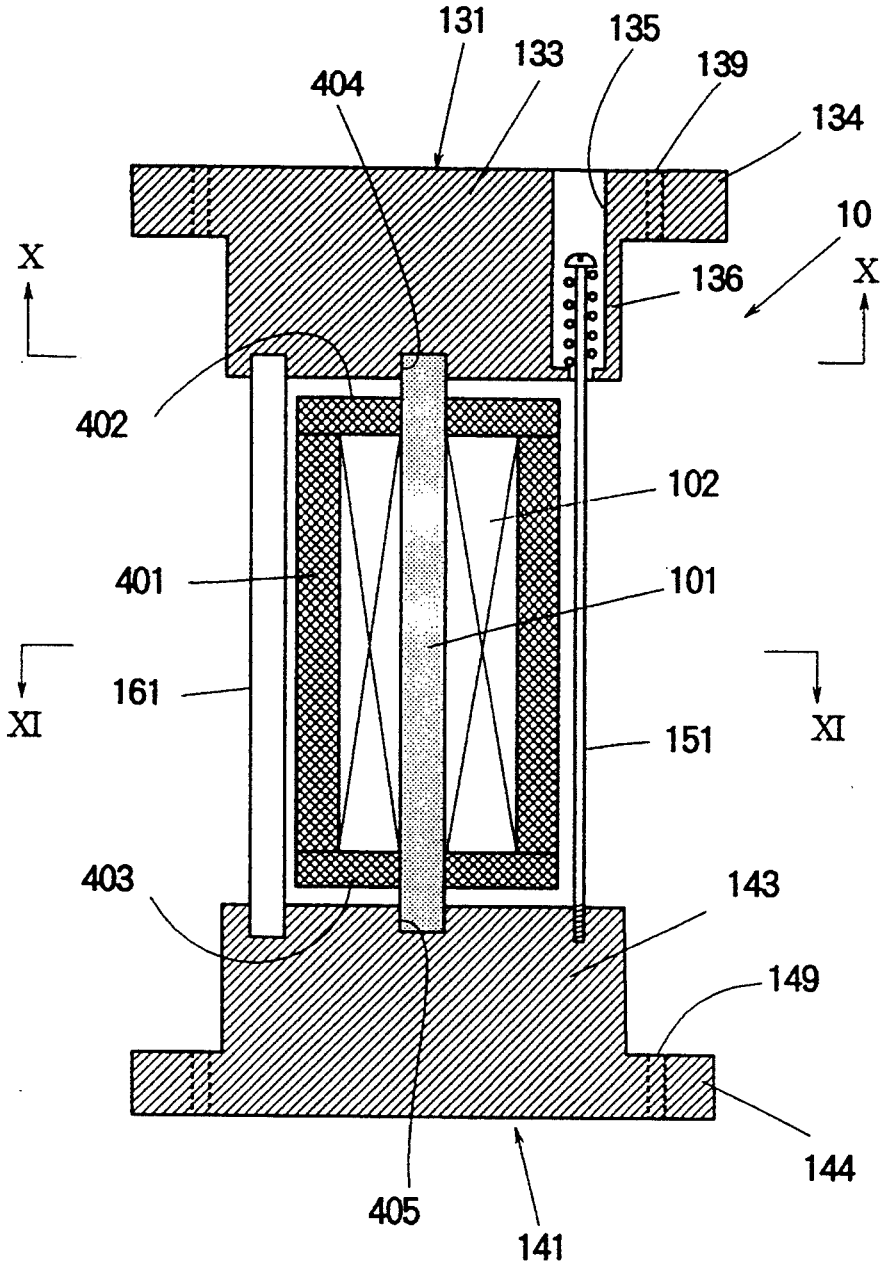
FIG. 9 is a sectional view of another example of vibrator units used to form the underwater low-frequency sound producer of FIG. 1.
Figure 10:
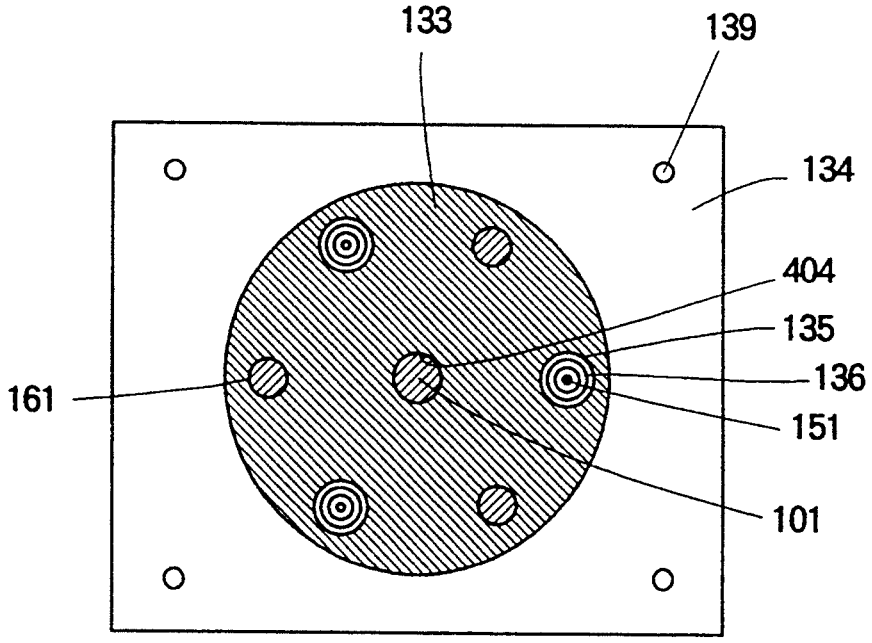
FIG. 10 is a sectional view along line X—X in FIG. 9.
Figure 11:
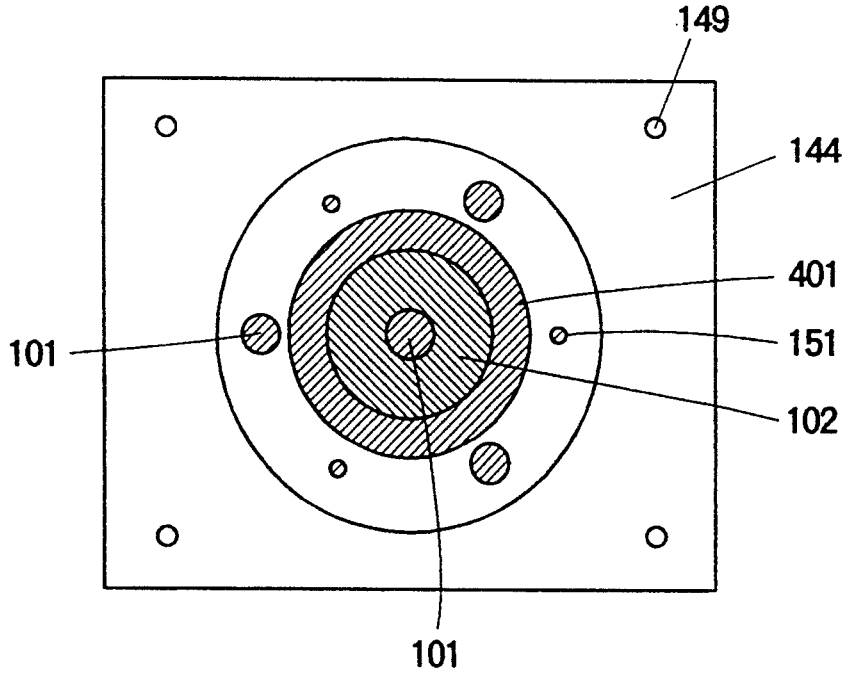
FIG. 11 is a sectional view along line XI—XI in FIG. 9.
Figure 12:
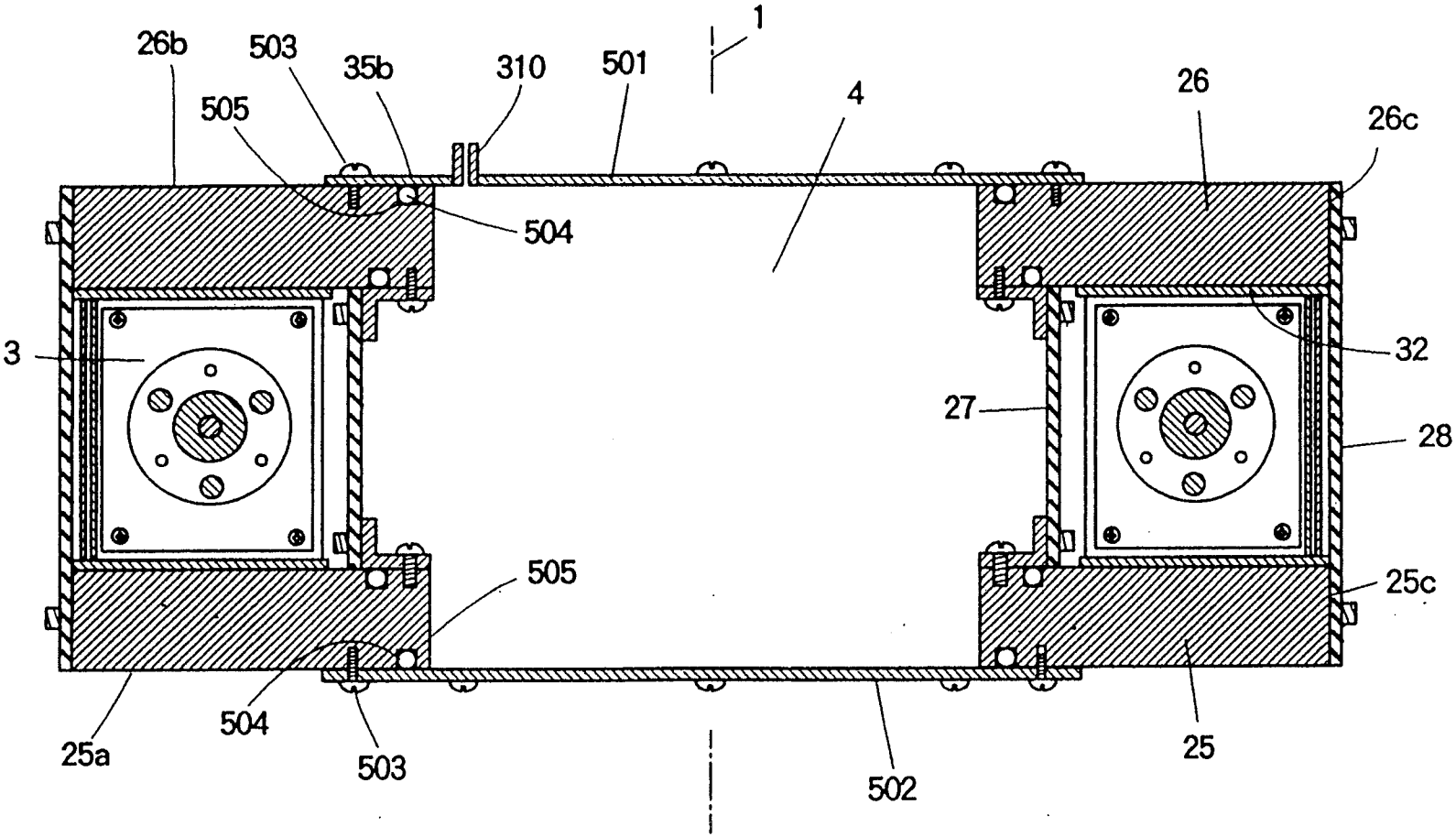
FIG. 12 is a sectional view, similar to FIG. 2, showing another embodiment of the invention.

In place of the vibrator unit 10 of FIG. 6 to FIG. 8, another example of vibrator unit 10 shown in FIG. 9 to FIG. 11 may be used. In this example, the disk-shaped permanent magnets 121 and 122 and the disk-shaped magnetic couplers 123 and 124 of FIG. 6 to FIG. 8 are not provided. Instead, a cylindrical permanent magnet 401 and a pair of disk-shaped yokes 402 and 403 are provided. The cylindrical permanent magnet 401 is disposed to surround the coil 102 wound on the rod 101. The yokes 402 and 403 are connected to the upper and lower ends of the cylindrical permanent magnet 401 to the upper and lower end parts of the magnetostrictive rod 101. The rod 101 has both ends received in indents 404 and 405 formed in the upper and lower masses 131 and 141. The magnetic flux from the permanent magnet 401 is passed through the yokes 402 and 403 and the magnetostrictive rod 101. The rod 101 thus receives a magnetic bias.

The rest of the configuration is identical to that described with reference to the example of FIG. 6 to FIG. 8. The vibrator units of FIG. 9 to FIG. 12 may be used in place of the vibrator units of FIG. 6 to FIG. 8, to form the sound producer like that shown in FIG. 1 to FIG. 4.

The invention is not limited to the embodiments described above, but various modifications are possible without departing from the spirit of the invention.

For instance, the connection members 20 and masses 131 and 141 of the respective vibrator units 10 are shown to be separate. But the masses 131 and 141 which are fixed to each of the connection members 20 may be formed integrally with (i.e., in one-piece unit with) such a connection member 20. A sound producer of such a modification may be described as comprising magnetostrictive rods 101 having first and second ends and arranged in such a manner that the first end of each rod is adjacent to a second end of another rod, with each vibration plate 24 being coupled to the first end of one of the rods 101 and the second end of another of the rods 101 adjacent to the above-mentioned one of the rods 101. The rods extend in a direction tangential to a circle centered on the axis 1. The first end of each of the rods is adjacent to the second end of another of the rods which is adjacent to said each of the rods.

In the embodiments described, eight vibrator units are used. The number of the vibrator units may be other than eight, but at least three vibrator units are required to define a ring. At present, using four to twenty vibrator units 10 is envisaged.

In the embodiments described, the sliding plates 32 of a plastic material is provided, and the upper and lower edges of the vibration plates 24 are in contact with the sliding plates 32. As an alternative, sliding plates of a hard metal may be used. In such a case, the vibration plates are provided in such a manner that their upper and lower edges are spaced by a small gap from the sliding surfaces. In such a configuration, the use of the sliding plates 32 of a hard metal ensure a high accuracy of the gap as the hard sliding plates is less subject to deformation by impact or scratching.

In the embodiments described, the rigid cylindrical wall 35 is provided to form the air chamber 4. Instead of the cylindrical wall 35, upper and lower flat walls 501 and 502 may be provided to form the air chamber 4. The upper and lower flat walls 501 and 502 may be fixed to the upper and lower plates 26 and 25 by means of screws 503 extending through holes in the upper and lower walls 501 and 502 and threaded into tapped holes in the upper and lower plates 26 and 25. O-rings 504 received in annular grooves 505 on the upper surface **26*b* of the upper plate 26 and the lower surface 25*a* of the lower plate 25 provide an water-tight-seal between the upper wall 501 and the upper plate 26 and between the lower wall 502 and the lower plate 25. A tube 310 similar to the one shown in FIG. 2 is also provided and extends through the upper plate 501, such that the tube 310 is in communication with the air chamber 4**.

The upper and lower walls 501 and 502 may be integral with the upper and lower plates 26 and 25, respectively. In such a case, the screws 503, the O-rings 504 and the annular grooves 505 are not required.

The terms "upper" and "lower" are used to describe the embodiments and the invention, but they are used for ease of understanding, and they do not necessarily mean the position or direction of the assembled device or the state in which they are placed for use.

As has been described, the vibrator units are connected to form a polygon or a ring, and vibrating plates are added, so that the resonant frequency can be set at will, and the resonant frequency of the overall sound producer can be lowered. Moreover, oil is used to compensate the pressure, and the structure can withstand a high pressure. Furthermore, by preventing the sound radiated from the inner surface **24*d* of the vibration plates 24 from emanating outward, by having the vibration plates 24 overlap each other, the efficiency of sound production is improved. Moreover, by the use of the vibration plates 24**, the area from which the sound is radiated is increased, so that the output power can be increased.

What is claimed is:

1. An underwater low-frequency sound producer using a rare earth alloy comprising:

(a) at least three vibrator units, each including a magnetostrictive rod formed of a rare-earth alloy, means for providing a magnetic bias to said rod, means for prestressing said rod, a coil magnetically coupled to said rod for causing magnetostriction of said rod corresponding to an input AC signal applied to said coil, and first and second masses on opposite ends of said rod;

(b) said vibrator units being arranged in such a manner that the first mass of each of said vibrator units is adjacent to the second mass of another of said vibrator units, each vibrator unit being so arranged that its rod extends substantially in the direction tangential to a circle centered on said axis;

(c) vibration plates, each provided for the first mass of each of said vibrator units and the second mass of another of said vibrator units;

(d) connection members, each connected to the first mass of each of the vibrator units and the second mass of another of said vibrator units;

(e) upper and lower plates and outer and inner boots defining a space which is centered on said axis and in which said vibrator units, said vibration plates and said connecting members are disposed; and (f) a liquid filling said space, said liquid having an acoustic impedance similar to that of the water in which the sound producer is placed for use.

2. An underwater low-frequency sound producer according to claim 1, wherein each of said masses has a flange for connection with the connection member.

3. An underwater low-frequency sound producer according to claim 1, wherein the assembly of said vibration plates form a cylindrical wall surrounding said vibrator units.

4. An underwater low-frequency sound producer according to claim 1, wherein said vibration plates have outer and inner surfaces and the adjacent vibration plates overlap each other to prevent the sound radiated from the inner surfaces of the vibration plates from emanating outward.

5. An underwater low-frequency sound producer according to claim 1, wherein the upper edges of the vibration plates are in proximity to the lower surface of the upper plate and the lower edges of the vibration plates are in proximity to the upper surface of the lower plate.

6. An underwater low-frequency sound producer according to claim 5, further comprising sliding plates which are attached on the lower surface of said upper plate and on the upper surface of said lower plate to avoid direct contact of the upper edges of the vibration plates with the lower surface of the upper plate and of the lower edges of the vibration plates with the upper surface of the lower plate.

7. An underwater low-frequency sound producer according to claim 1, further comprising supporting rods wrapped with a buffer material passed through holes in the respective connection members and fixed at their upper and lower ends to said upper and lower plates.

8. An underwater low-frequency sound producer according to claim 1, further comprising an air chamber formed inside said inner boot.

9. An underwater low-frequency sound producer according to claim 8, wherein said vibration plates have outer and inner surfaces, and said sound producer further comprises a wall positioned inside of the inner boot, to form an air chamber between the wall and the inner boot.

10. An underwater low-frequency sound producer according to claim 9, further comprising means for connecting the air chamber to an external pressure compensator to obtain a pressure balance between the air in the air chamber and the external water.

11. An underwater low-frequency sound producer according to claim 1, wherein said vibration plates are removably attached to said connection members to permit replacement.

12. An underwater low-frequency sound producer according to claim 1, wherein said outer and inner boots are cylindrical, and said spaced defined by said outer and inner boots and said upper and lower plates is an annular space.

13. An underwater low-frequency sound producer according to claim 1, wherein said space is sealed by the upper and lower plates and the outer and inner boots.

14. An underwater low-frequency sound producer using a rare earth alloy comprising:

(a) at least three magnetostrictive rods each having first and second ends and arranged in such a manner that the first end of each of said rods is adjacent to the second end of another of said rods;

(b) means for providing a magnetic bias to each of said rods;

(c) means for prestressing each of said rods;

(d) means for applying an AC magnetic field to each of said rods;

(e) vibration plates, each provided for a first end of one said rods and a second end of another of said rods adjacent to said one of said rods;

(f) means for connecting each of said vibration plates to said first end of said one of said rods and said second end of said another of said rods;

(g) upper and lower plates and outer and inner boots for defining a space which is centered on said axis and in which said rods, said connecting means and said vibration plates are positioned; and (h) a liquid filling said space, said liquid having an acoustic impedance similar to that of the water in which the sound producer is placed for use.

15. An underwater low-frequency sound producer according to claim 14, wherein each of said rods is provided with first and second masses on its first and second ends;

said connecting means comprises connection members, connecting the first and second masses adjacent to each other to said vibration plates.

16. An underwater low-frequency sound producer according to claim 15, wherein said mass has a flange for connection with the connection member.

17. An underwater low-frequency sound producer according to claim 14, wherein supporting rods wrapped with a buffer material is passed through holes of the respective connection members and fixed at their upper and lower ends to said upper and lower plates.

18. An underwater low-frequency sound producer according to claim 17, further comprising sliding plates which are attached on the lower surface of said upper plate and on the upper surface of the lower plate to avoid direct contact of the upper edges of the vibration plates with the lower surface of the upper plate, and of the lower edges of the vibration plates with the upper surface of the lower plate.

19. An underwater low-frequency sound producer according to claim 14, wherein said vibration plates have outer and inner surfaces and the adjacent vibration plates overlap each other to prevent sound radiated from the inner surfaces (**24*d***) of the vibration plates from emanating outward.

20. An underwater low-frequency sound producer according to claim 14, further comprising an air chamber formed inside said inner boot.

21. An underwater low-frequency sound producer according to claim 20, wherein said vibration plates have outer and inner surfaces, and said sound producer further comprises a wall positioned inside of the inner boot, to form said air chamber between the wall and the inner boot.

22. An underwater low-frequency sound producer according to claim 21, further comprising means for connecting the air chamber to an external pressure compensator to obtain a pressure balance between the air in the air chamber and the external water.

23. An underwater low-frequency sound producer according to claim 14, wherein said vibration plates are removably attached to said connection members to permit replacement.

24. An underwater low-frequency sound producer according to claim 14, wherein said outer and inner boots are cylindrical, and said spaced defined by said outer and inner boots and said upper and lower plates is an annular space.

25. An underwater low-frequency sound producer according to claim 14, wherein said vibration plates form a cylindrical wall surrounding said rods.

26. An underwater low-frequency sound producer according to claim 14, wherein said space is sealed by the upper and lower plates and the outer and inner boots.

27. An underwater low-frequency sound producer according to claim 14, wherein the upper edges of the vibration plates are in proximity to the lower surface of the upper plate and the lower edges of the vibration plates are in proximity to the upper surface of the lower plate.

* * * * *